US007739776B2

(12) United States Patent
Hume

(10) Patent No.: US 7,739,776 B2
(45) Date of Patent: Jun. 22, 2010

(54) MODULAR COLUMBARIUM SYSTEM

(76) Inventor: James M. Hume, 2555 County Road 13A South, Eleton, FL (US) 32033

( * ) Notice: Subject to any disclaimer, the term of this patent is extended or adjusted under 35 U.S.C. 154(b) by 441 days.

(21) Appl. No.: 11/973,489

(22) Filed: Oct. 9, 2007

(65) Prior Publication Data

US 2009/0199376 A1 Aug. 13, 2009

Related U.S. Application Data

(60) Provisional application No. 60/850,522, filed on Oct. 10, 2006.

(51) Int. Cl.
*A61G 17/00* (2006.01)

(52) U.S. Cl. ..... 27/35; 27/1; 52/134

(58) Field of Classification Search ..... 27/35, 27/1; 52/134, 136; 211/85.27; D99/5; 206/503, 206/504, 509; 220/23.2, 23.4, 23.6
See application file for complete search history.

(56) References Cited

U.S. PATENT DOCUMENTS 3,183,574 A * 5/1965 Diem ..... 27/1
3,417,521 A * 12/1968 Welsh ..... 52/90.1
3,529,730 A * 9/1970 Thompson ..... 211/85.27
3,754,805 A * 8/1973 Pangburn et al. ..... 312/111
3,925,944 A * 12/1975 Pickel ..... 52/134
5,287,603 A * 2/1994 Schorman ..... 27/1
5,740,637 A * 4/1998 Snow ..... 52/136
6,161,268 A * 12/2000 Joseph ..... 27/35
6,167,600 B1 * 1/2001 Williams et al. ..... 27/1
6,250,025 B1 * 6/2001 Darby ..... 52/137
6,421,890 B1 * 7/2002 Biggar ..... 27/1
7,171,733 B2 * 2/2007 Min ..... 27/35
7,243,405 B1 * 7/2007 Green ..... 27/1

* cited by examiner

*Primary Examiner*—William L. Miller

(57) ABSTRACT

A modular columbarium system comprised of modular niche units each having a plurality of urn niches defined therein, wherein adjacent modular niche units are secured to one utilizing an interlocking system that provides alignment and stabilization of the units. The columbarium system is a modular design which facilitates the easy relocation of the modular niche units and the redesign of the columbarium system. The interlocking system connects the modules of the columbarium system to one another to enable easy expansion of the system without diminishing its stability. The modular niche units can also be used with existing columbarium systems. Memorial plates of various sizes are provided to cover the niche openings such that couples or family members can be grouped together under one memorial plate.

24 Claims, 7 Drawing Sheets

MODULAR COLUMBARIUM SYSTEM

CROSS REFERENCE TO RELATED APPLICATION

Claim of Priority

This application claims priority of the Provisional Application No. 60/850,522 entitled: MODULAR COLUMBARIUM SYSTEM, filed on Oct. 10, 2006.

BACKGROUND OF THE INVENTION

1. Field of the Invention

The present invention relates generally to storage and display systems for containers holding cremation ashes or remains. In particular, the present invention relates to a columbarium system that is compact, modular and expandable.

2. Description of the Prior Art

Cremation of the remains of humans and animals, such as pets, has become increasingly popular in the recent years. For social, economic and religious reasons, people have turned to cremation of the remains of a deceased as an acceptable alternative to preservation and burial of the remains. Whether the remains of a deceased are preserved and buried or cremated, traditionally, there is a time honored need for memorialization of the deceased. Memorialization provides a visual symbol that functions as a reminder of the deceased. In most cases, this visual symbol is simply a location where the remains of an individual are afforded a physical resting place that can be identified by name and dates. Most families find that a memorial, regardless of its size, serves a basic human need to remember and to be remembered. Notwithstanding the foregoing, preparation of a deceased's remains by cremation, as with traditional burial, is simply one step in the memorialization process. Once a deceased's remains have been cremated, the final disposition of the cremated remains and the memorial selected for the remains must be selected. Such memorials are varied and numerous.

Of course, one time honored tradition is to simply spread the remains in a location of significance to the deceased, such as a garden. In such cases, a plaque, tree, or similar reminder may be utilized as a visual symbol to remember the deceased. For remains that are contained in a permanent container, such as an urn, one option is to inter the remains in a burial chamber or family plot. Cemeteries often permit the interment of cremated remains of more than one person in a single adult space. Burial chambers are desirable in cases where casketed remains are to be interred with cremated remains.

Another option for the memorialization of cremated remains is an urn garden or similar location specifically designed for the interment of cremated remains. Even with cremation, some desire ground or above-ground interment where a marker can be placed.

Still yet another option for the memorialization of cremated remains is in a columbarium. A columbarium is an indoor or outdoor wall containing niches or recessed compartments in which urns are placed. Columbariums of the prior art are permanent structures that typically range in size from entire buildings to individuals walls. Such walls may be incorporated in rooms, chambers, alcoves, mausoleums, chapels or similar structures or may be freestanding. The niches of columbariums typically come in many sizes to accommodate the numerous and varied selection of urns that are available. Some niches are capable of containing two or more urns, such as for families. Niche coverings may be glass, marble, bronze, mosaic, granite or the like.

One drawback to columbariums of the prior art is that they are fixed structures that are generally installed at the time of creation of the larger memorial. In this regard, the number of niches available is limited and expansion requires significant structural changes. For example, one of the most famous columbariums originally built in 1897 is the Columbarium on Loraine Court in San Francisco. The ornate structure was fixed in size and niche capacity and now requires new construction to add on wings for additional niches. In this same vein, these traditional columbarium systems are not easily installed, and once installed, are permanent in nature and cannot be relocated or moved. Likewise, fixed construction is typically expensive. Furthermore, since traditional columbariums are designed for their particular environment, indoor columbarium designs are not generally suitable for outdoor use.

It is an object of the present invention to provide a modular columbarium system that is flexible in construction, capacity, shape and look. Such a modular system would be easily expandable to meet increased capacity needs. While the system should be stable and secure when assembled, such a system should be readily capable of disassembly, transport and reassembly as desired.

Such a modular system should be configurable as necessary to accommodate various space requirements, whether installed as a free-standing wall or installed in even small spaces such as unused alcoves and the like.

It is another object of the present invention to provide a columbarium system that is configured in an efficient manner such that a greater volume of cremation urns can be stored in the modular system than in the prior art columbarium systems.

It is also desirable that such a modular system should be capable of installation either indoors or outdoors.

These, and other, objects and advantages of the present invention will become clear after careful consideration is given to the following detailed description of the preferred embodiment.

SUMMARY OF THE INVENTION

The present invention provides a modular columbarium system generally comprising a base unit, a niche unit, a cap unit and an interlocking system that attaches niche units to one another. Each modular niche unit has a plurality of niches disposed therein into which an urn containing compacted cremains can be inserted. Preferably the number of niches is selected so as to permit the niche unit to be substantially square with evenly spaced apart niches. Multiple niche units can be secured on top of one another to form a niche column. Likewise, multiple niche units can be secured adjacent one another to form a niche wall. The base unit is a foundation unit which elevates and secures niche units in freestanding systems. The niche units are modular units that permit design flexibility, mobility and easy expansion. The interlocking system is generally comprised of pins/connectors and receptors provided in the tops and bottoms of niche units, and optionally on the rear and sides, to permit alignment between adjacent units and to secure units to one another. The interlocking system likewise provides stability to the overall columbarium system.

In one preferred embodiment, memorial plates are use to cover the tubular niches. Memorial plates are preferably a standard size so as to cover a single niche. The memorial plates can be provided in a variety of materials and colors to permit design flexibility. In one preferred embodiment, the columbarium system includes security features such as security head screws and metal anchors to attach memorial plates to the niche units thereby protecting the niche contents.

The cap unit is an optional decorative piece for the tops of niche columns. Cap units can also be placed between stacked niche units to provide relief therebetween. The benefits of a modular columbarium system include expandable columbaria, niche systems that can be reconfigured, easy columbarium relocation, and compact niches for reduced space.

DETAILED DESCRIPTION OF THE PREFERRED EMBODIMENTS

In the detailed description of the invention, like numerals are employed to designate like parts throughout. Various items of equipment, such as fasteners, fittings, etc., may be omitted to simplify the description. However, those skilled in the art will realize that such conventional equipment can be employed as desired.

Figure 1:
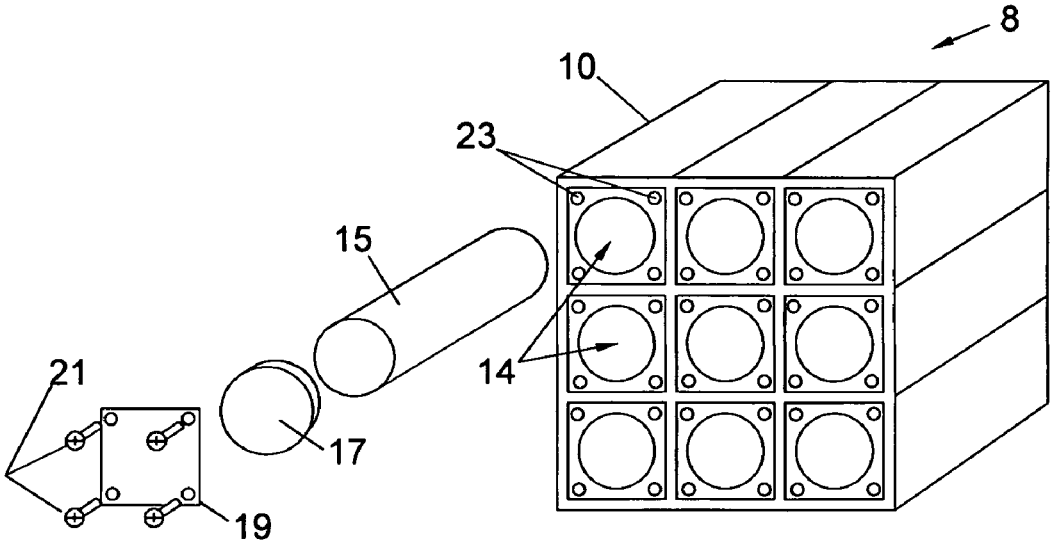
FIG. 1 is a perspective view of the invention shown as an assembled unit and prepared to accept sealed urns.

With specific reference to FIG. 1, the modular columbarium system 8 comprises a plurality of niche units 10. In the illustrated embodiment and as specifically shown in FIGS. 1 and 2, each niche unit 10 includes a plurality of in a stacked, modular configuration. Each niche unit 10 includes a plurality of open tubes or urn niches 14 for receiving an ash urn 15. Typically, the ash urn is sealed with a lid 17. The ash urn is placed in the urn niche 14 and secured therein with a plate 19 which is mounted on the face of the niche unit 10 by a plurality of fasteners 21 received in holes 23. The face of the plate 19 may be engraved with information about the contents of the urn.

Figure 2:
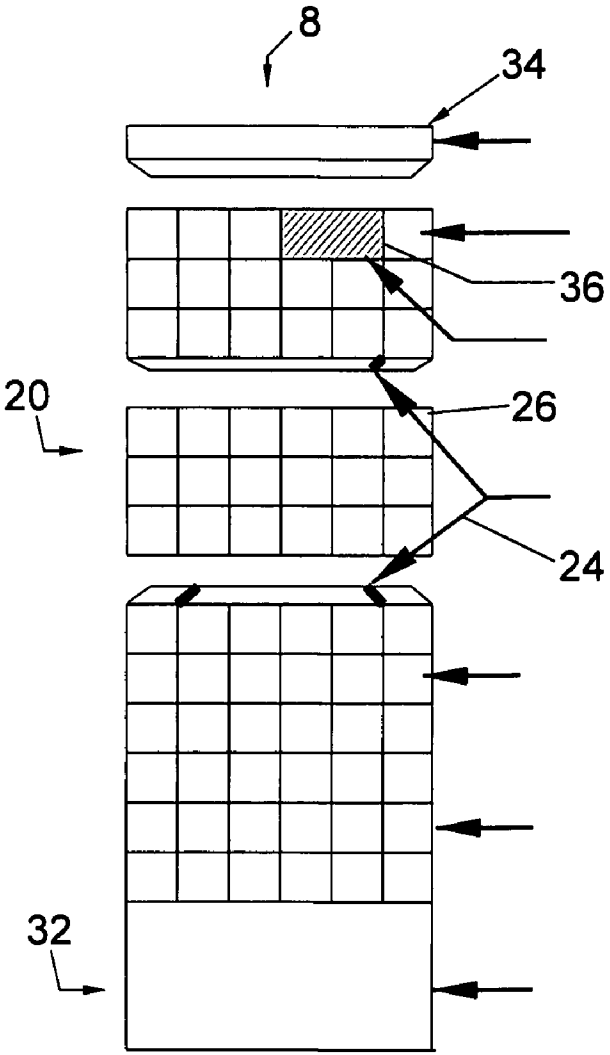
FIG. 2 is a perspective view of the various parts of a modular columbarium system in accordance with the present invention.
Figure 3:
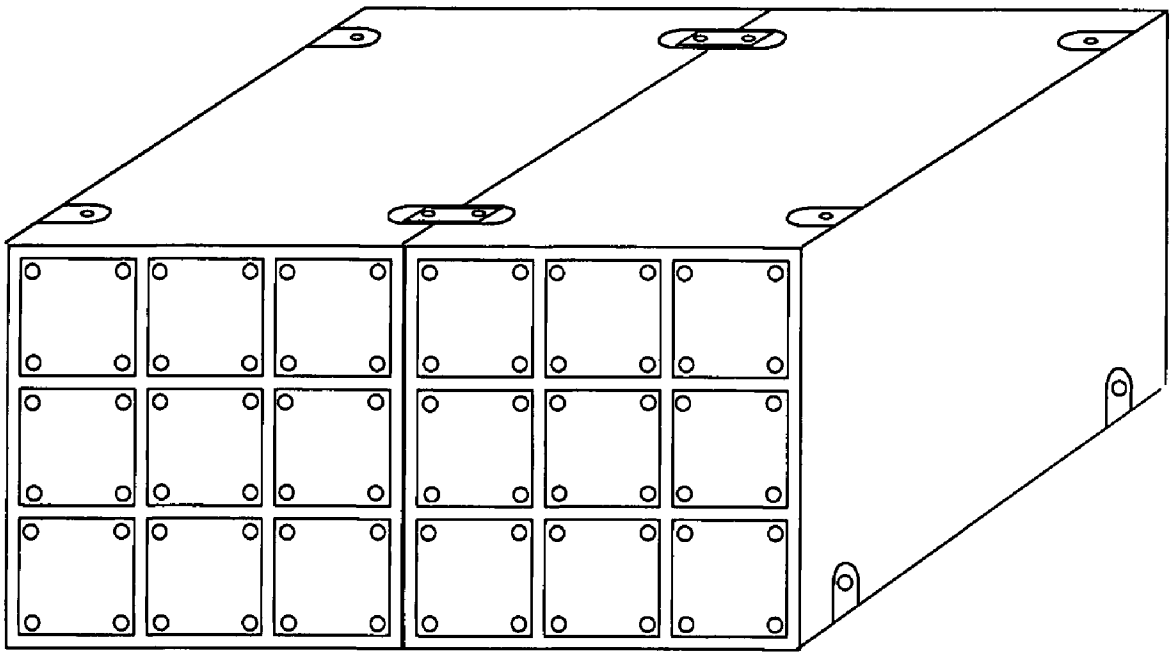
FIG. 3 is a perspective view of two niche units attached adjacent one another to form a wall.
Figure 7:
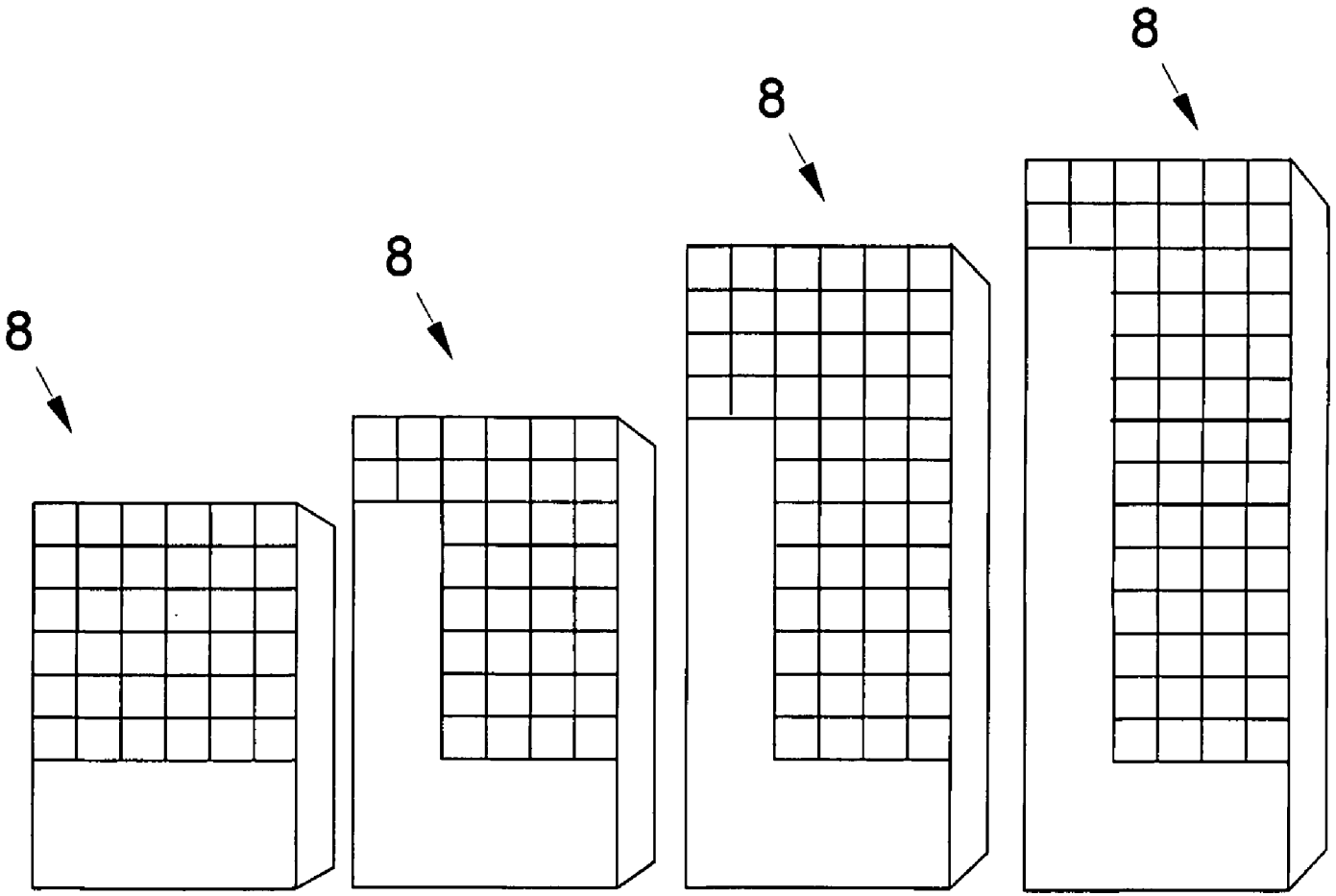
FIG. 7 is a perspective view of multiple columbarium systems configured to have different heights.

FIGS. 2 and 3 illustrate the various parts of a modular columbarium system 8 in accordance with the present invention. The modular columbarium system 8 generally comprises modular niche units 10 and an interlocking system 22 to securing modular niche units 10 to one another. The modular niche units 10 can be secured to one another either in a stacked configuration to form a modular columbarium column (FIG. 7) or a side-by-side configuration to form a modular columbarium wall (FIG. 3) or in a combination thereof (FIG. 2). Modular columbarium system 8 may further include a base unit 32 and a cap unit 34. The base unit 32 is a foundation unit which secures and elevates modular niche units 10 for columbarium systems that are freestanding. In freestanding configurations, modular columbarium columns and walls of varying heights can be formed, as shown in FIG. 7, by stacking side-by-side modular niche units 10 on top of the base unit 32 and also other modular niche units 10 to form a modular columbarium column. Interlocking system 22 permits adjacent individual niche units 10 to be secured to one another, either vertically or horizontally. Interlocking system 22 can also function to secure modular niche units 10 to the topside of the base unit 32, and to secure cap unit 34 to the top of modular niche units 10. The cap unit 34 is an optional decorative piece for the tops of modular columbarium columns or relief between modular niche units 10.

Figure 4:
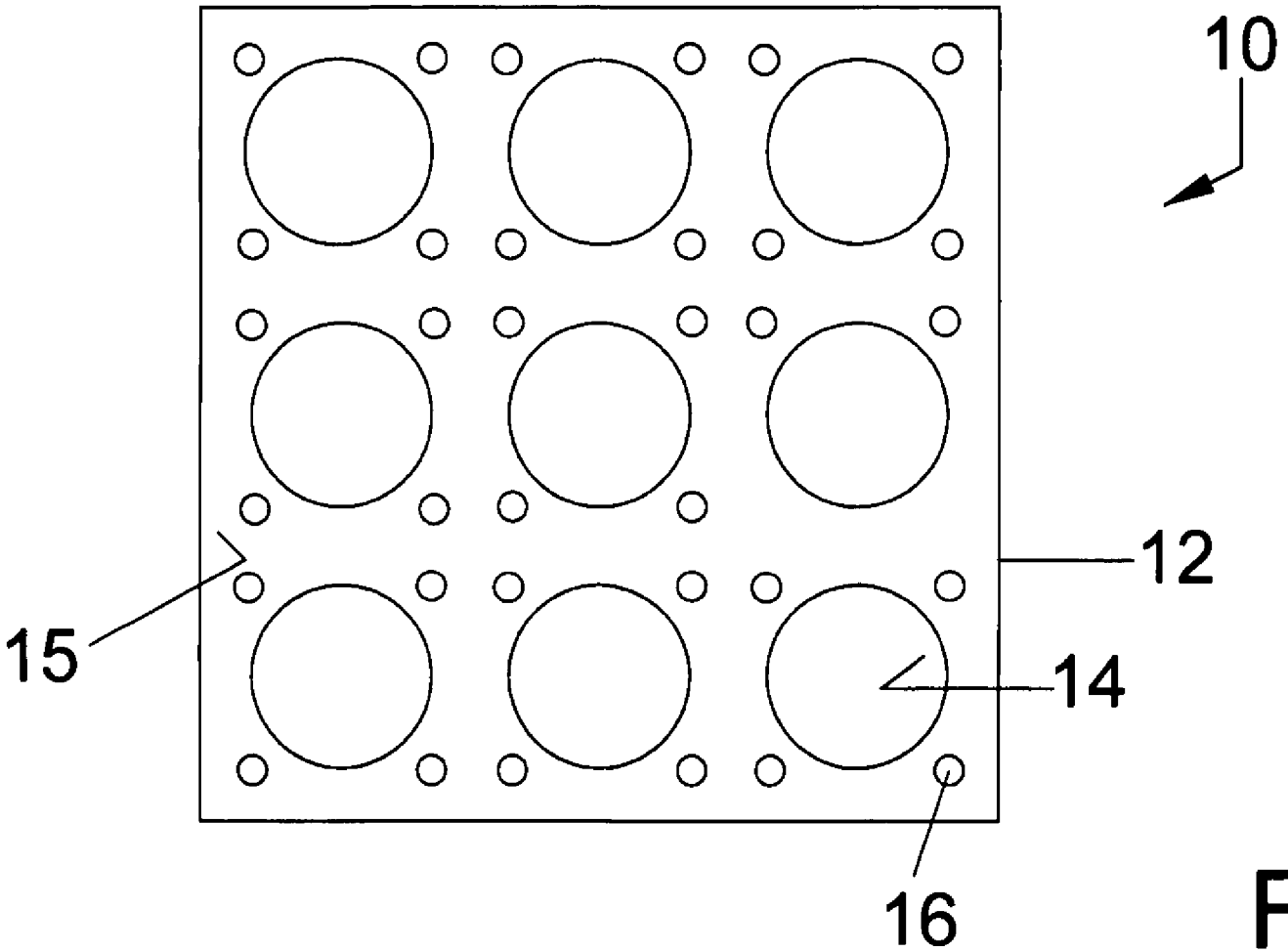
FIG. 4 is a front view of a single niche unit.

FIG. 4 illustrates a front view of a single modular niche unit 10 in accordance with the present invention. The modular niche unit 10 is a block 12 in which is defined a plurality of niches 14 extending from the face 15 of block 12. Each niche 14 is disposed for receipt of an urn 36 (FIG. 2). While block 12 may be of any dimension so long as multiple niches 14 are defined in a single block, in the preferred embodiment, face 15 of block 12 is 12 inches×12 inches and is comprised of nine niches 14, preferably set in a 3 inch×3 inch pattern. In an alternative embodiment, the number of niches is selected so as to permit the niche unit to be substantially square with evenly spaced apart niches. Likewise, while niches 14 can be sized to accommodate urns 36 of varying dimensions and shapes, the columbarium system 8 of the invention is particularly well suited for use with tubular shaped urns with compacted cremains disposed therein. Such urns are typically no larger than six inches in diameter and range from 8 inches to 14⅝ inches in length. In such case, niches 14 are tubular in shape and uniform in dimension. As such, a greater number of niches 14 can be defined in a single modular unit 10. In one preferred embodiment, the outside diameter of the tubular niches 14 is approximately 3.67 inches. It is the compact and uniform nature of the urns, and hence the small diameter of the niches, that permits meaningful modularity of niche units 10.

In any event, as shown in FIGS. 1-5, each niche unit 10 includes locking fasteners 16 and niche cover 18. Niche covers 18 are individual plates that cover one or more niches 14. For example, a niche cover 18 may be disposed to cover a single niche 14 or, groups of niches holding the cremains of couples or families. Niche covers 18 may serve as a memorial plate for the cremains disposed within a niche. Locking fasters 16 are preferably security head screws and metal anchors that removably secure niche covers 18 to face 15, thereby allowing the cremation urn to be removed, viewed, and/or even transported to a different location.

Figure 5:
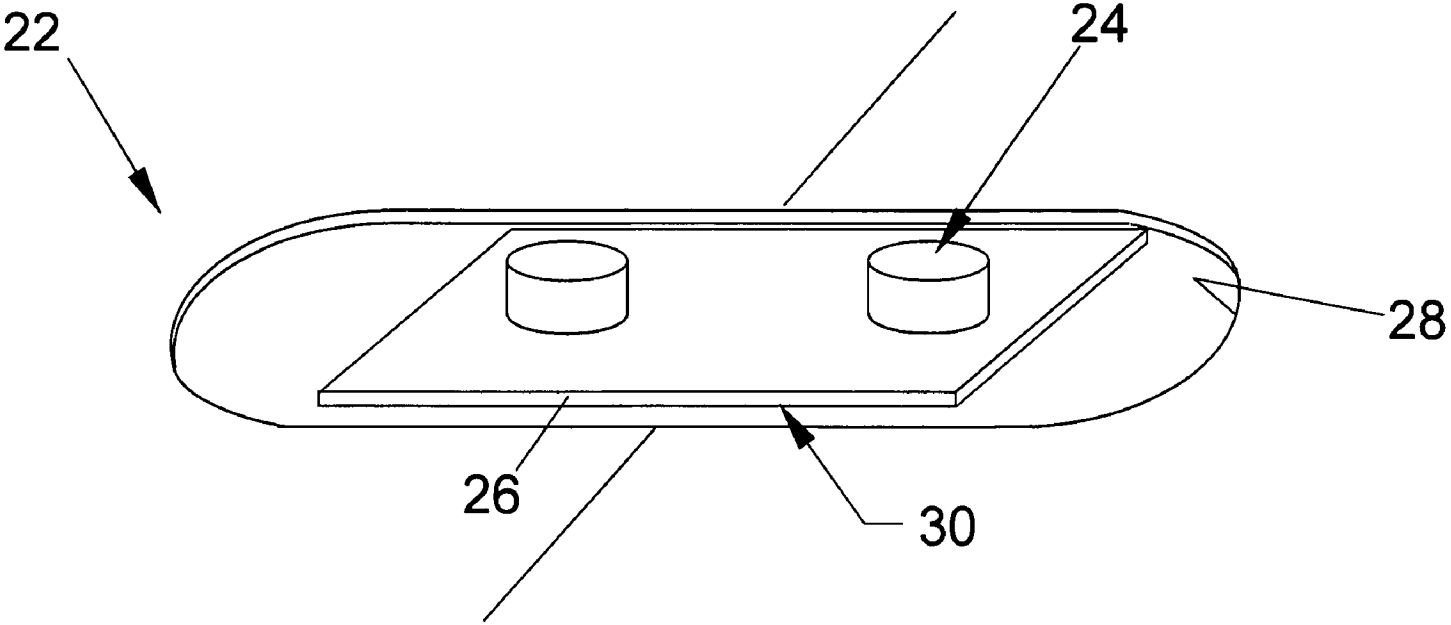
FIG. 5 is a perspective view of the interlocking system of the columbarium system.

FIGS. 3 and 5 illustrate interlocking system 22 with more specificity. FIG. 3 in particular, illustrates two modular niche units 10 attached side-by-side to one another utilizing interlocking system 22 to form a wall 20, while FIG. 5 illustrates the components of interlocking system 22. More specifically, each modular niche unit 10 is defined by a top surface 17 and a bottom surface 19. A plurality of locator pins 24 extend from top surface 17, while a plurality of alignment apertures 26 are disposed in bottom surface 19. Pins 24 and apertures 26 are positioned on their corresponding surfaces 17, 19, respectively, so that pins 24 on the top of one unit 10 will seat in apertures 26 on the bottom of another unit 10 when the units are stacked on top of one another. In such alignment, adjacent faces 15 will be flush with one another. Thus, locator pins 24 and apertures 26 are used to both align stacked units 10 with one another and secure those units to one another.

In the preferred embodiment, a pin recess 28 is defined in top surface 17 around each pin 24 and extends from pin 24 to the edge of unit 10. When adjacent units 10 are aligned to form a wall 20, such as in FIG. 3, pin recesses 28 of the adjacent units 10 will be aligned such that a coextensive recess extends between adjacent pins 24. A stabilizer strap 30 is then secured over adjacent pins 24, thereby securing adjacent units 10 to one another. Preferably, stabilizer strap 30 has a thickness that is the same as or less than the depth of recess 28 so that stabilizer trap 30 will be flush with surface 17 when disposed around pins 24. This will in turn permit adjacent units stacked on top of one another to fit flush with one another. Stabilizer strap may be rigid, semi-rigid or flexible and may be formed of any desirable material so long as the strap secures adjacent units 10 to one another. In one preferred embodiment, stabilizer strap 30 is metal. A fastener may be secured on pin 24 to ensure strap 30 remains engaged therewith.

In another embodiment of the present invention, the locator pins 24 and corresponding alignment apertures 26 may also be placed on the sides of units 10. Likewise, pin recesses 28 may also be defined on the sides and back of each units 10, thereby permitting stacked units 10 to be secured to one another along their vertical surfaces utilizing stabilizer straps 30 as described above.

Those skilled in the art will appreciate that while the interlocking system 22 permits the formation of a stable and sturdy columbarium system 8, it also permits system 8 to be readily broken down and disassembled for transport or altered as necessary for expansion of the capacity of columbarium system 8.

Figure 6:
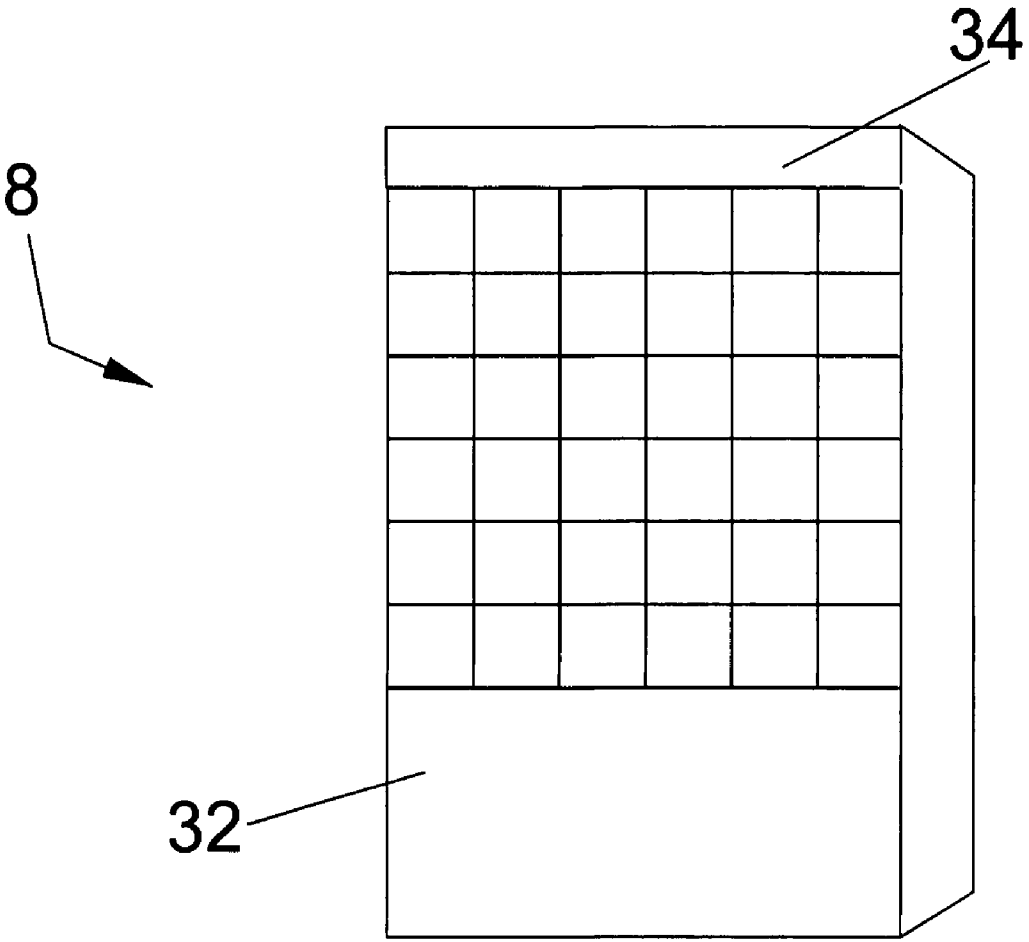
FIG. 6 is a perspective view of a freestanding columbarium wall formed of multiple niche units.

FIGS. 6 and 7 both show a free-standing modular columbarium system. FIG. 7 additionally shows a free-standing modular columbarium system as modular niche units 10 are added on top of an existing columbarium column so that the height of the column can be progressively increased as the need for additional niche space arises. In each of the Figures, a two column free-standing columbarium system 8 having a cap unit 34 attached to a modular niche unit 10, which is attached to another modular niche unit 10, which is then attached to a base unit 32. Expansion of the columbarium system 8 can be easily achieved by lifting the cap unit 34 and placing a modular niche unit 10 followed by placing the cap unit 34 on top of the added modular niche unit 10. This procedure of adding additional modular niche units 10 can be repeated until the desired height is reached.

The modular columbarium system described herein provides many benefits over prior art columbaria and solves many deficiencies found in the prior art. The modular design of the niche units 10 allows columbarium systems to be built in phases, thus being truly expandable. The modular nature of the columbarium system 8 and niche units 10 also permits the columbarium system 8 to be more readily relocated or rearranged as desired.

Since the size of urns containing compacted cremains as described above are only about 50% of the size of traditional urns, to the extent a columbarium system 8 of the invention is dimensioned for receipt of urns with such compacted cremains, a 12 inch×12 inch niche space of the present invention can easily fit nine cremation urns 36, whereas the same space in a traditional columbarium would fit only one or two urns.

Another advantage of the current invention is that niche covers or memorial plates 18 can be designed such that they can be fitted to cover one niche or multiple grouped niches so that couples or families can be covered by just one niche cover. This design allows family members to be placed under one cover so that they can be together even after death.

The modular nature of the columbarium system 8 provides the ability to construct the system either as stand-alone units or as incorporated into some type of structure like a wall, fence or gazebo. In this same vein, the columbarium system can be easily customized in shape and size to fit in a desired space, or to increase the capacity of an existing system.

Still yet another benefit of modular columbarium system 8 is that the niche units 10 they can be manufactured using almost any material, non-limiting examples including without limitation, marble, granite, wood or similar traditional columbarium materials, or even non-traditional materials such as concrete or plastics, the material being selected based on the particular specifications of a system. Selection criteria for materials may include the location of the system, i.e., indoors or outdoors, the need to resist mold, mildew, mausoleum insects or various natural or man made elements, or the need to satisfy certain maximum weight requirements.

While a preferred embodiment of the invention has been described, it is appreciated that variations and modifications may be made without departing from the scope and spirit of the following claims.

What is claimed is:

1. A modular columbarium system for storing urns comprising:

A. at least two niche units, each of which is provided with at least two niches for receipt of a respective said urn; and B. an interlocking system connecting said niche units to one another, wherein said interlocking system is comprised of pins extending from each niche unit and a strap disposed to fit over adjacent pins of adjacent niche units, wherein said pins are positioned on a top face of each niche unit adjacent side faces of the niche unit and extend perpendicularly from said top face, and wherein a recess is disposed in the top face around each pin adjacent the side face and extends perpendicularly from the side face to which the pin is adjacent.

2. The columbarium system of claim 1, wherein said niche unit is integrally formed.

3. The columbarium system of claim 1, wherein said at least two niches are integrally formed in said niche unit.

4. The columbarium system of claim 1, wherein said niche units are provided with at least four niches.

5. The columbarium system of claim 1, wherein said niche units are provided with at least nine niches.

6. The system of claim 1, wherein said niches are tubular.

7. The system of claim 1, wherein each niche unit is defined by a front face, said top face, a bottom face, a back face and said side faces and wherein said niches are perpendicularly defined in said front face.

8. The system of claim 1, wherein each niche unit is defined by a front face, said top face, a bottom face, a back face and said side faces.

9. The system of claim 8, further comprising an additional niche unit and alignment apertures provided in the bottom face of each niche unit, said alignment aperture positioned therein so that at least one of said pins in said adjacent units will seat in the aperture of the additional niche unit when said additional niche unit is positioned on top of one of said adjacent niche units, wherein said side faces and front face of said additional niche unit are substantially flush with the side faces and front face of the niche unit on which it is placed when said pin is seated in said aperture.

10. The columbarium system of claim 1, wherein said niche has a diameter no larger than 4 inches.

11. The columbarium system of claim 1, wherein said niche has a diameter no larger than 3.6 inches.

12. The columbarium system of claim 1, wherein said niche unit comprised an integrally formed block with said niches disposed therein.

13. The columbarium system of claim 12, wherein said block is formed of masonry building materials.

14. The columbarium system of claim 12, wherein said block is formed of concrete.

15. The columbarium system of claim 12, wherein said block is formed of polymers.

16. The system of claim 1, further comprising a base unit positioned under said adjacent modular niche units.

17. The system of claim 1, further comprising a niche plate disposed over at least one of said niches.

18. A modular columbarium system for storing urns comprising:

A. at least two modular niche units, each niche unit comprising (1) a block, said block having a front face, a top face, a bottom face, a back face and side faces;

(2) at least nine tubular, spaced apart niches perpendicularly defined in said front face for receipt of a respective said urn;

(3) at least two recesses disposed in the top face of said block on opposing sides of said top face adjacent said side faces, wherein each recess extends perpendicularly from the side face to which it is adjacent;

(4) a pin disposed in each recess and extending perpendicular to said top face above said top face;

(5) wherein said niche units are positioned adjacent one another so that said corresponding top faces and front faces are substantially flush with one another when said side faces of the adjacent units abut each other, and (6) wherein the recesses extending from the abutting side faces are coextensive with one another so as to form a recessed area between adjacent pins; and B. a stabilizer strap disposed around said adjacent pins and extending in said recessed area between said adjacent pins.

19. The system of claim 18, further comprising at least one additional niche unit, wherein said additional niche unit is provided with at least one alignment aperture disposed in the bottom face of said additional unit, said alignment aperture positioned therein so that at least one of said pins in said adjacent units will seat in the aperture when said additional niche unit is positioned on top of one of said adjacent niche units, wherein said side faces and front face of said additional niche unit are substantially flush with the side faces and front face of the niche unit on which it is placed when said pin is seated in said aperture.

20. The system of claim 18, further comprising a cap unit extending across the top faces of said adjacent modular niche units.

21. A modular columbarium system for storing urns comprising:

A. at least two modular niche units, each niche unit comprising (1) a block, said block having a front face, a top face, a bottom face, a back face and side faces;

(2) at least nine tubular, spaced apart niches perpendicularly defined in said front face for receipt of a respective said urn;

(3) at least two recesses disposed in each side face, one recess adjacent the top face and one recess adjacent the bottom face, wherein each recess extends perpendicularly from the face to which it is adjacent;

(4) a pin disposed in each recess and extending perpendicular to said side face;

(5) wherein said niche units are positioned on top of one another so that said corresponding side faces and front faces are substantially flush with one another when so positioned; and (6) wherein the recesses extending from adjacent side faces are coextensive with one another so as to form a recessed area between adjacent pins; and B. a stabilizer strap disposed around said adjacent pins and extending in said recessed area between said adjacent pins.

22. The system of claim 21, further comprising at least one pin disposed in the top face of one unit and at least one alignment aperture disposed in the bottom face of said other unit, each positioned therein so that the pin will seat in the aperture when said niche units are positioned on top of one another and the corresponding side faces and front faces are substantially flush with one another.

23. The system of claim 21, further comprising a base unit positioned under said stacked modular niche units.

24. The system of claim 21, further comprising a cap unit affixed to the top face of said top modular niche unit.

* * * * *